US012546046B2

(12) United States Patent
Reeves et al.

(10) Patent No.: US 12,546,046 B2
(45) Date of Patent: Feb. 10, 2026

(54) DRYER APPLIANCE WITH ADAPTIVE CYCLE PARAMETERS

(71) Applicant: Haier US Appliance Solutions, Inc., Wilmington, DE (US)

(72) Inventors: Joshua Reeves, Louisville, KY (US); Ryan James Scheckelhoff, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 1130 days.

(21) Appl. No.: 17/520,989

(22) Filed: Nov. 8, 2021

(65) Prior Publication Data

US 2023/0143674 A1 May 11, 2023

(51) Int. Cl.

| | |
|---|---|
| ***D06F 34/18*** | (2020.01) |
| ***D06F 34/06*** | (2020.01) |
| ***D06F 58/38*** | (2020.01) |
| ***D06F 58/46*** | (2020.01) |
| ***D06F 101/14*** | (2020.01) |

(Continued)

(52) U.S. Cl.

CPC ..... *D06F 34/18* (2020.02); *D06F 34/06* (2020.02); *D06F 58/38* (2020.02); *D06F 58/46* (2020.02); *D06F 2101/14* (2020.02); *D06F 2101/16* (2020.02); *D06F 2103/08* (2020.02); *D06F 2103/40* (2020.02); *D06F 2105/12* (2020.02)

(58) Field of Classification Search

CPC ..... D06F 34/18; D06F 34/06; D06F 2101/14; D06F 2101/16; D06F 2103/08; D06F 2105/12; D06F 58/02; D06F 58/46; D06F 2103/40; D06F 2105/28; D06F 2105/56; D06F 58/38

See application file for complete search history.

(56) References Cited

U.S. PATENT DOCUMENTS 2,787,841 A 4/1957 Warino
2,951,595 A 9/1960 Pierie
(Continued)

FOREIGN PATENT DOCUMENTS

CN 205711482 U 11/2016
CN 109629207 A 4/2019
(Continued)

OTHER PUBLICATIONS

Translation, KR-20190103879-A (Year: 2019).*
Translation, WO-2016174810-A1 (Year: 2016).*

*Primary Examiner* — Jessica Yuen
(74) *Attorney, Agent, or Firm* — Dority & Manning, P.A.

(57) ABSTRACT

A method of operating a dryer appliance includes performing a first sensor cycle of the dryer appliance. The first sensor cycle includes rotating a drum of the dryer appliance and activating a heating system of the dryer appliance according to a first set of cycle parameters. The method also includes detecting one or more user interactions with the dryer appliance and inferring from the one or more detected user interactions that the dry performance of the first sensor cycle was unsatisfactory. The method further includes defining a second set of cycle parameters in response to the one or more detected user interactions. The method also includes performing a second sensor dry cycle of the dryer appliance according to the second set of cycle parameters after the first sensor dry cycle.

19 Claims, 3 Drawing Sheets

(51) Int. Cl.

| | |
|---|---|
| ***D06F 101/16*** | (2020.01) |
| ***D06F 103/08*** | (2020.01) |
| ***D06F 103/40*** | (2020.01) |
| ***D06F 105/12*** | (2020.01) |

(56) References Cited

U.S. PATENT DOCUMENTS

| | | | |
|---|---|---|---|
| 3,320,683 | A | 5/1967 | Worst |
| 5,570,520 | A | 11/1996 | Huffington |
| 2005/0016015 | A1 | 1/2005 | Prajescu |
| 2007/0062061 | A1 | 3/2007 | Carow |
| 2007/0084254 | A1 | 4/2007 | Messina |
| 2014/0345155 | A1 | 11/2014 | Contarini |
| 2020/0190721 | A1 | 6/2020 | Kim |

FOREIGN PATENT DOCUMENTS

| | | | | | |
|---|---|---|---|---|---|
| CN | 112411113 | A | | 2/2021 | |
| EP | 1707663 | A1 | | 10/2006 | |
| EP | 2593602 | A1 | | 5/2013 | |
| EP | 2733253 | A1 | | 5/2014 | |
| EP | 3348694 | B1 | | 7/2018 | |
| KR | 20190103879 | A | * | 9/2019 | ..... D06F 58/28 |
| KR | 20210063082 | A | | 6/2021 | |
| WO | WO2006097364 | A1 | | 9/2006 | |
| WO | WO-2016174810 | A1 | * | 11/2016 | ..... D06F 58/38 |

* cited by examiner

DRYER APPLIANCE WITH ADAPTIVE CYCLE PARAMETERS

FIELD OF THE INVENTION

The present subject matter relates generally to dryer appliances, and more particularly to dryer appliances configured for detecting user dissatisfaction with drying performance thereof and adapting cycle parameters in response to the detected dissatisfaction.

BACKGROUND OF THE INVENTION

A conventional appliance for drying articles such as a clothes dryer (or laundry dryer) for drying clothing articles typically includes a cabinet having a rotating drum for tumbling clothes and laundry articles therein. One or more heating elements, for example electric heating elements, heat air prior to the air entering the drum, and the warm air is circulated through the drum as the clothes are tumbled to remove moisture from laundry articles in the drum.

In some instances, a dryer appliance may over dry a load of articles therein. Over drying, such as continued heating of articles beyond the point at which the articles are dry, may result in damage, e.g., shrinkage, to some articles. Under drying may result in articles which retain a higher moisture content than desired after the dryer operation is completed.

Typical dryer appliances may use sensors to determine when a load of articles is done. Such sensor-based operations, however, are set up based on assumed conditions or average conditions and may not provide satisfactory drying performance across all installation conditions or all use cases. Variations in, for example, vent installation conditions or user preferences may result in instances of over drying or under drying in some dryer appliances when standardized sensor operations are performed.

Accordingly, a dryer appliance having features for adapting operations thereof to provide satisfactory drying performance across a wider range of conditions would be advantageous.

BRIEF DESCRIPTION OF THE INVENTION

Aspects and advantages of the invention will be set forth in part in the following description, or may be obvious from the description, or may be learned through practice of the invention.

In an exemplary aspect of the present disclosure, a method of operating a dryer appliance is provided. The dryer appliance includes a cabinet with a drum rotatably mounted within the cabinet. The drum defines a chamber for the receipt of articles for drying. The dryer appliance also includes a heating system fluidly coupled to the drum whereby heated air flows from the heating system to the chamber of the drum for drying of articles within the chamber. The method includes performing a first sensor cycle of the dryer appliance. The first sensor cycle includes rotating the drum of the dryer appliance and activating the heating system of the dryer appliance according to a first set of cycle parameters. The method also includes detecting one or more user interactions with the dryer appliance and inferring from the one or more detected user interactions that the dry performance of the first sensor cycle was unsatisfactory. The method further includes defining a second set of cycle parameters in response to the one or more detected user interactions. The method also includes performing a second sensor dry cycle of the dryer appliance according to the second set of cycle parameters after the first sensor dry cycle.

In another exemplary aspect of the present disclosure, a dryer appliance is provided. The dryer appliance includes a cabinet with a drum rotatably mounted within the cabinet. The drum defines a chamber for the receipt of articles for drying. The dryer appliance also includes a heating system fluidly coupled to the drum whereby heated air flows from the heating system to the chamber of the drum for drying of articles within the chamber. The dryer appliance further includes a controller. The controller is configured for performing a first sensor cycle of the dryer appliance. The first sensor cycle includes rotating the drum of the dryer appliance and activating the heating system of the dryer appliance according to a first set of cycle parameters. The controller is also configured for detecting one or more user interactions with the dryer appliance and inferring from the one or more detected user interactions that the dry performance of the first sensor cycle was unsatisfactory. The controller is further configured for defining a second set of cycle parameters in response to the one or more detected user interactions. The controller is also configured for performing a second sensor dry cycle of the dryer appliance according to the second set of cycle parameters after the first sensor dry cycle.

These and other features, aspects, and advantages of the present disclosure will become better understood with reference to the following description and appended claims. The accompanying drawings, which are incorporated in and constitute a part of this specification, illustrate embodiments of the disclosure and, together with the description, serve to explain the principles of the disclosure.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
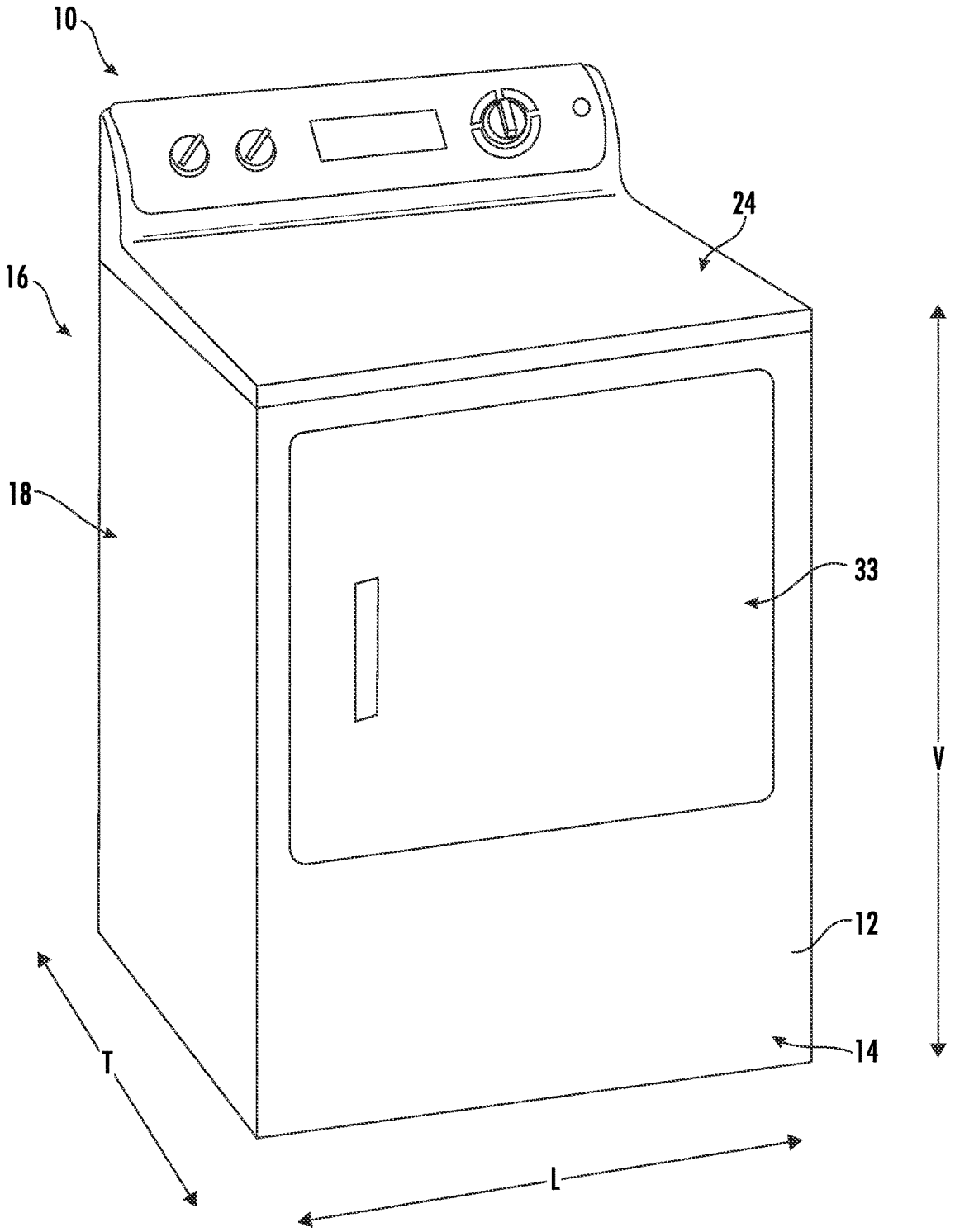
FIG. 1 provides a perspective view of a dryer appliance in accordance with exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
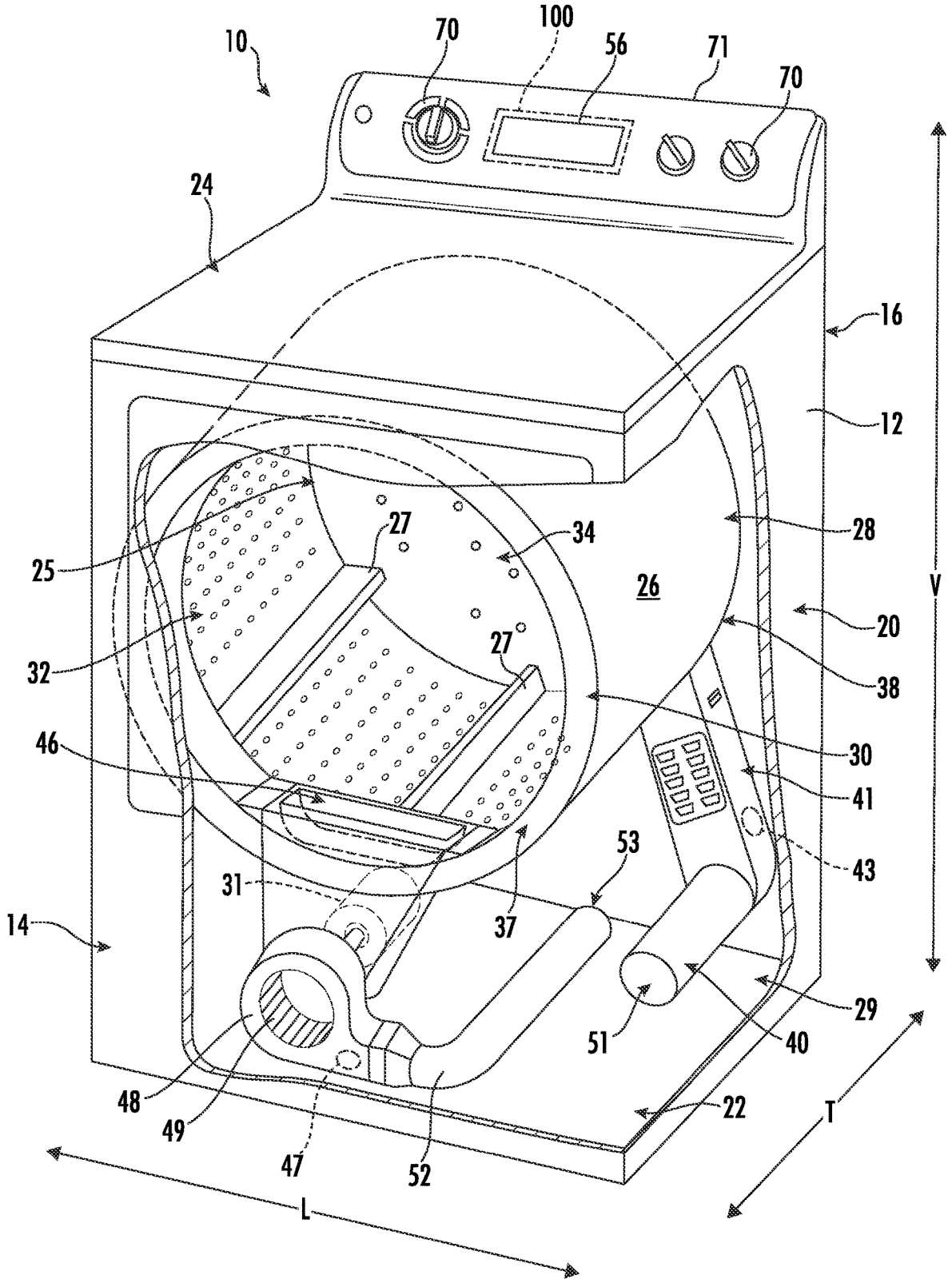
FIG. 2 provides a perspective view of the example dryer appliance of FIG. 1 with portions of a cabinet of the dryer appliance removed to reveal certain components of the dryer appliance.

Turning now to the figures, FIG. 1 provides a perspective view of dryer appliance 10 according to one or more exemplary embodiments of the present disclosure. FIG. 2 provides another perspective view of dryer appliance 10 with a portion of a cabinet or housing 12 of dryer appliance 10 removed in order to show certain components of dryer appliance 10. Dryer appliance 10 generally defines a vertical direction V, a lateral direction L, and a transverse direction T, each of which is mutually perpendicular, such that an orthogonal coordinate system is defined. While described in the context of a specific embodiment of dryer appliance 10, using the teachings disclosed herein, it will be understood that dryer appliance 10 is provided by way of example only. Other dryer appliances having different appearances and different features may also be utilized with the present subject matter as well.

Cabinet 12 includes a front panel 14, a rear panel 16, a pair of side panels 18 and 20 spaced apart from each other by front and rear panels 14 and 16, a bottom panel 22, and a top cover 24. Within cabinet 12, an interior volume 29 is defined. A drum or container 26 is mounted for rotation about a substantially horizontal axis within the interior volume 29. Drum 26 defines a chamber 25 for receipt of articles of clothing for tumbling and/or drying. Drum 26 extends between a front portion 37 and a back portion 38. Drum 26 also includes a back or rear wall 34, e.g., at back portion 38 of drum 26. A supply duct 41 may be mounted to rear wall 34 and receives heated air that has been heated by a heating assembly or system 40.

As used herein, the terms "clothing" or "articles" includes but need not be limited to fabrics, textiles, garments, linens, papers, or other items from which the extraction of moisture is desirable. Furthermore, the term "load" or "laundry load" refers to the combination of clothing that may be washed together in a washing machine or dried together in a dryer appliance 10 (e.g., clothes dryer) and may include a mixture of different or similar articles of clothing of different or similar types and kinds of fabrics, textiles, garments and linens within a particular laundering process.

A motor 31 is provided in some embodiments to rotate drum 26 about the horizontal axis, e.g., via a pulley and a belt (not pictured). Drum 26 is generally cylindrical in shape, having an outer cylindrical wall 28 and a front flange or wall 30 that defines an opening 32 of drum 26, e.g., at front portion 37 of drum 26, for loading and unloading of articles into and out of chamber 25 of drum 26. A plurality of lifters or baffles 27 are provided within chamber 25 of drum 26 to lift articles therein and then allow such articles to tumble back to a bottom of drum 26 as drum 26 rotates. Baffles 27 may be mounted to drum 26 such that baffles 27 rotate with drum 26 during operation of dryer appliance 10.

Drum 26 includes a rear wall 34 rotatably supported within main housing 12 by a suitable fixed bearing. Rear wall 34 can be fixed or can be rotatable. Rear wall 34 may include, for instance, a plurality of holes that receive hot air that has been heated by a heating assembly or system 40, as will be described further below. Motor 31 is also in mechanical communication with an air handler 48 such that motor 31 rotates a fan 49, e.g., a centrifugal fan, of air handler 48. Air handler 48 is configured for drawing air through chamber 25 of drum 26, e.g., in order to dry articles located therein. In alternative example embodiments, dryer appliance 10 may include an additional motor (not shown) for rotating fan 49 of air handler 48 independently of drum 26.

Drum 26 is configured to receive heated air that has been heated by a heating assembly 40, e.g., via holes in the rear wall 34 as mentioned above, in order to dry damp articles disposed within chamber 25 of drum 26. For example, heating assembly 40 may include a heating element (not shown), such as a gas burner, an electrical resistance heating element, or heat pump, for heating air. In particular embodiments, the heating assembly 40 may be or include an electric heater comprising a plurality of electric resistance heating elements with a plurality of relays for selectively providing or obstructing electrical power to the heating elements, such as two relays which permit operation of the heating assembly 40 at various power levels, such as 50% power when only one of two relays is closed. As discussed above, during operation of dryer appliance 10, motor 31 rotates drum 26 and fan 49 of air handler 48 such that air handler 48 draws air through chamber 25 of drum 26 when motor 31 rotates fan 49. In particular, ambient air enters heating assembly 40 via an inlet 51 due to air handler 48 urging such ambient air into inlet 51. Such ambient air is heated within heating assembly 40 and exits heating assembly 40 as heated air. Air handler 48 draws such heated air through supply duct 41 to drum 26. The heated air enters drum 26 through a plurality of outlets of supply duct 41 positioned at rear wall 34 of drum 26.

Within chamber 25, the heated air may accumulate moisture, e.g., from damp clothing disposed within chamber 25. In turn, air handler 48 draws moisture-saturated air through a screen filter (not shown) which traps lint particles. Such moisture-statured air then enters an exit duct 46 and is passed through air handler 48 to an exhaust duct 52. From exhaust duct 52, such moisture-statured air passes out of dryer appliance 10 through a vent 53 defined by cabinet 12. After the clothing articles have been dried, they are removed from the drum 26 via opening 32. A door 33 (FIG. 1) provides for closing or accessing drum 26 through opening 32. The door 33 may be movable between an open position and a closed position, the open position for access to the chamber 25 defined in the drum 26, and the closed position for sealingly enclosing the chamber 25 defined in the drum 26.

In some embodiments, one or more selector inputs 70, such as knobs, buttons, touchscreen interfaces, etc., may be provided or mounted on a cabinet 12 (e.g., on a backsplash 71 of the cabinet 12) and are in operable communication (e.g., electrically coupled or coupled through a wireless network band) with a processing device or controller 100. A display 56 may also be provided on the backsplash 71 and may also be in operable communication with the controller 100. Controller 100 may also be provided in operable communication with motor 31, air handler 48, and/or heating assembly 40. In turn, signals generated in controller 100 direct operation of motor 31, air handler 48, and/or heating assembly 40 in response to the position of inputs 70. In the example illustrated in FIG. 2, the inputs 70 are provided as knobs. In other embodiments, inputs 70 may also or instead include buttons, switches, touchpads and/or a touch screen type interface.

Controller 100 is a "processing device" or "controller" and may be embodied as described herein. As used herein, "processing device" or "controller" may refer to one or more microprocessors, microcontrollers, application-specific integrated circuits (ASICS), or semiconductor devices and is not restricted necessarily to a single element. The controller 100 may be programmed to operate dryer appliance 10 by executing instructions stored in memory (e.g., non-transitory media). The controller 100 may include, or be associated with, one or more memory elements such as RAM, ROM, or electrically erasable, programmable read only memory (EEPROM). For example, the instructions may be software or any set of instructions that when executed by the processing device, cause the processing device to perform operations. Controller 100 may include one or more processor(s) and associated memory device(s) configured to perform a variety of computer-implemented functions and/or instructions (e.g. performing the methods, steps, calculations and the like and storing relevant data as disclosed herein). It should be noted that controllers as disclosed herein are capable of and may be operable to perform any methods and associated method steps as disclosed herein. For example, in some embodiments, methods disclosed herein may be embodied in programming instructions stored in the memory and executed by the controller.

In some exemplary embodiments, the dryer appliance 10 may include one or more temperature sensors, such as inlet temperature sensor 43 and/or outlet temperature sensor 47. The temperature sensor(s) may be in operative communication with the controller 100. For example, in various embodiments, the controller 100 may be operable to detect, measure, and/or monitor one or more temperatures within the dryer appliance 10. Such temperatures which may be detected, measured, and/or monitored include, for example, an inlet temperature measured with the inlet temperature sensor 43 and/or an outlet temperature measured with the outlet temperature sensor 47. The temperature sensors 43 and 47 may be, in some embodiments, thermistors.

Figure 3:
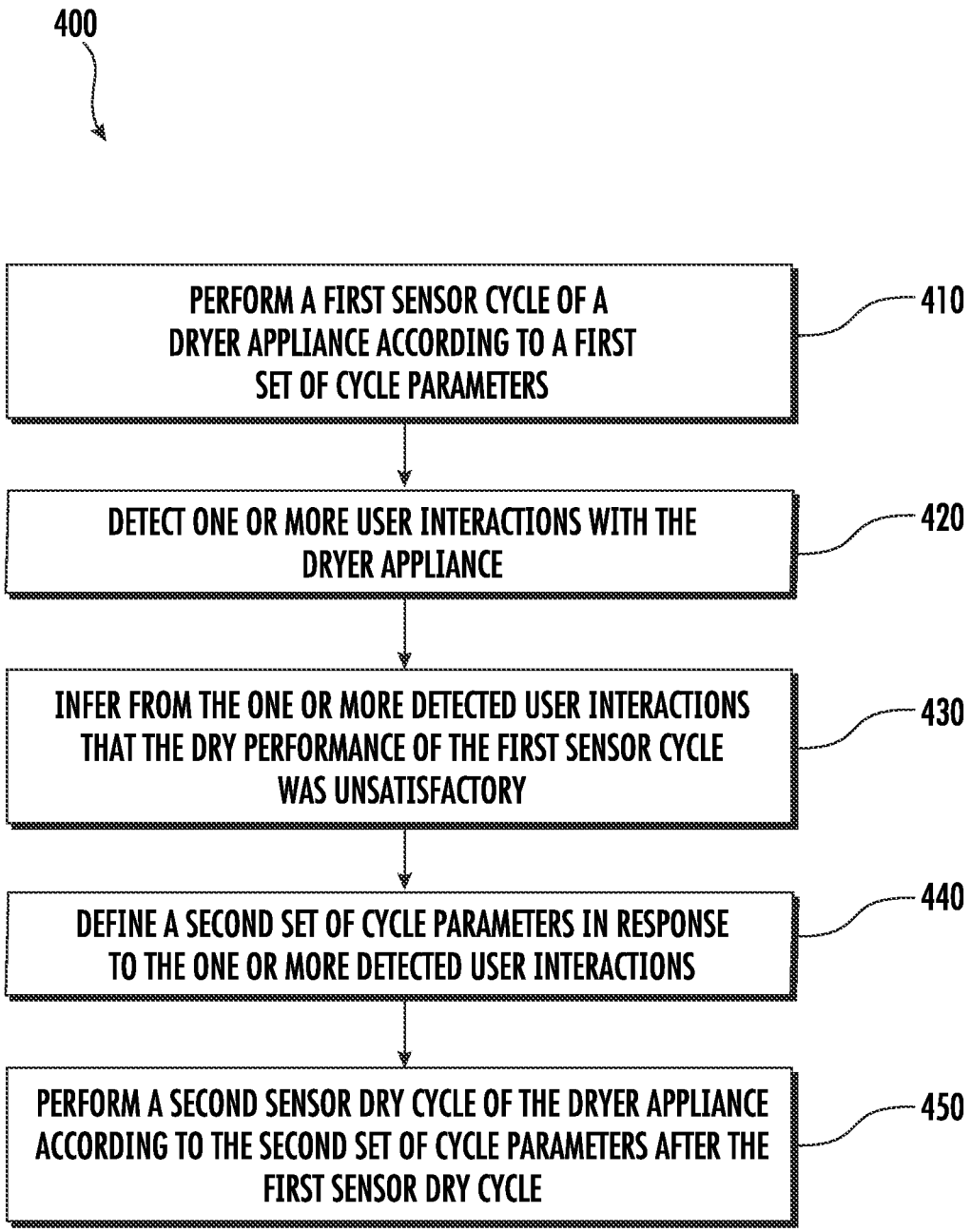
FIG. 3 provides a flow chart of an exemplary method of operating a dryer appliance according to one or more embodiments of the present disclosure.

FIG. 3 provides a flow chart of an exemplary method 400 of operating a dryer appliance according to one or more additional embodiments of the present disclosure. Method 400 may include performing a first sensor cycle of the dryer appliance, as indicated at 410 in FIG. 3. The first sensor cycle includes rotating a drum of the dryer appliance and activating a heating system of the dryer appliance according to a first set of cycle parameters. The first set of cycle parameters may be, e.g., a default set of cycle parameters programmed into the dryer appliance, such as into a memory of a controller of the dryer appliance. The default set of cycle parameters may be preprogrammed prior to installation of the dryer appliance, such as in a factory, and/or prior to any operations or cycles being performed by the dryer appliance.

In some embodiments, method 400 may further include a step 420 of detecting one or more user interactions with the dryer appliance. The user interactions may be detected during or shortly after the first sensor cycle. User interactions detected "shortly after" the first sensor cycle may be detected within about fifteen minutes or less after the termination of the first sensor cycle, such as within about ten minutes or less after the termination of the first sensor cycle, such as within about five minutes or less after the termination of the first sensor cycle, such as within about one minute or less after the termination of the first sensor cycle. User interactions detected "shortly after" the first sensor cycle may also include user interactions that are detected in the absence of a door opening after the termination of the first sensor cycle, or where a door opening after the termination of the first sensor cycle is detected, followed by a door closing within about two minutes or less after the door opening, such as about one minute or less after the door opening, such as within about thirty seconds after the door opening.

Method 400 may also, in some exemplary embodiments, include a step 430 of inferring from the one or more detected user interactions that the dry performance of the first sensor cycle was unsatisfactory. For example, based on the particular user interaction that is detected, a possible over dry or a possible under dry may be detected. Accordingly, method 400 may further include a step 440 of defining a second set of cycle parameters in response to the one or more detected user interactions. For example, if the detected user interaction indicates a possible under dry, the second set of cycle parameters may include settings to increase drying, such as increased heat level and/or increased drying time, etc., whereas if the detected user interaction indicates a possible over dry the second set of cycle parameters may include settings to decrease drying, such as decreased heat level and/or decreased drying time, etc.

After defining the second set of cycle parameters, method 400 may then include a step 450 of performing a second sensor dry cycle of the dryer appliance according to the second set of cycle parameters after the first sensor dry cycle.

In some embodiments, the one or more detected user interactions may include a timer cycle selection input after the first sensor cycle. In particular, the timer cycle selection input may indicate that the same load of articles is being dried again (thus indicating a possible under dry). For example, when the timer cycle selection input is received within a first time threshold of the termination of the first sensor cycle, this may indicate that the load of articles from the first sensor dry cycle has not been removed from the dryer appliance. The first time threshold may be about fifteen minutes or less, such as about ten minutes or less, such as about five minutes or less, such as about two minutes or less, such as about one minute. Also by way of example, when the timer cycle selection input includes a selected cycle duration of less than a second time threshold, this may indicate that only partial drying is desired, e.g., to complete drying of the load of articles from the first sensor dry cycle which are already at least partially dry from the first sensor dry cycle, as opposed to drying a different load of articles which are starting out at a moisture content that is closer to saturation than the moisture content of the load of articles from the first sensor dry cycle. The second time threshold may be about thirty minutes or less, such as about twenty minutes or less, such as about fifteen minutes or less, such as about ten minutes or less, such as about five minutes.

As mentioned above, the detected user interaction may be detected shortly after the termination of the first sensor dry cycle, such as when the door of the dryer appliance has not been opened after the termination of the first sensor dry cycle. For example, in some embodiments, the one or more detected user interactions may include initiating a cycle of the dryer appliance, such as a timed dry cycle, a sensor dry cycle, or other drying cycle, after the first sensor cycle without opening a door of the dryer appliance after the first sensor cycle.

In some embodiments, the one or more detected user interactions may include repeating the first sensor cycle after a termination of the first sensor cycle. For example, the first sensor cycle, e.g., a sensor dry cycle with the same selected cycle parameters and options, may be repeated shortly after the termination of the first sensor cycle, where "shortly after" may include within a time limit and/or based on detected door positions, as described above.

In some embodiments, the one or more detected user interactions may include selecting the same cycle for a similar load of articles as the first sensor cycle, and selecting a different dryness setting, e.g., a higher dryness setting or a lower dryness setting, than a dryness setting of the first sensor cycle. For example, in contrast to repeating the first sensor dry cycle with all the same selections as described above, every selection of the subsequent cycle may be the same except a dryness setting, and the different dryness setting may be higher (suggesting a possible under dry) or lower (suggesting a possible over dry) than the dryness setting of the first sensor dry cycle. As another example, a temperature setting selection may be the only changed setting, or the dryness and temperature settings may both be changed, where both are changed in the same direction, e.g., either both increased or both decreased. The similar load of articles may be detected in various ways. For example, in some embodiments, the dryer appliance may be in communication with a washing machine appliance, and, in such embodiments, the similar load of articles may be based on a load type of the load of articles detected by the washing machine appliance and transmitted to the dryer appliance from the washer appliance being the same or similar for the subsequent load of articles as for the load of articles from the first sensor dry cycle. As another example, in some embodiments, the similar load of articles may be detected based on a user habit, such as a load of darks being dried every Thursday, wherein a subsequent Thursday includes the cycle with the different, e.g., higher or lower, dryness setting and/or temperature setting.

In some embodiments, the one or more detected user interactions may include opening a door of the dryer appliance prior to completion of the first sensor cycle and without running another cycle of the dryer appliance within a time threshold after opening the door. Detecting a premature door opening, e.g., before the completion of the first sensor cycle, may indicate a possible over dry, but may also indicate a user is checking on the load of articles, or adding/removing one or two articles from the load, or other scenarios. When the premature door opening is coupled with an absence of restarting the first sensor cycle or initiating another cycle thereafter, the possible over dry is more likely.

In some embodiments, the one or more detected user interactions may include a non-heated cycle selection received immediately after a termination of the first sensor cycle. Such non-heated cycle, e.g., an air fluff cycle, may be initiated to cool down an overdried load of articles. Thus, detecting a non-heated cycle selection received immediately after a termination of the first sensor cycle (where "immediately after" refers to without any other intervening user interactions such as opening and closing a door or initiating another cycle after the termination of the first sensor cycle and before the non-heated cycle selection) may indicate a possible over dry.

In some embodiments, the one or more detected user interactions may include a time setting selection received during the first sensor dry cycle, such as an attempt by a user to add or remove time from the sensor dry cycle. In particular, sensor dry cycles do not refer to time setting selections, where such time setting selections are instead used for timed dry cycles, yet a user may attempt to adjust the sensor cycle by adding to or reducing the time of the cycle using the time setting selections. Such attempts may be detected user interactions and may indicate user dissatisfaction, such as a possible under dry or over dry. For example, a detected attempt to add time to the sensor cycle may indicate a possible under dry and a detected attempt to reduce the time of the sensor cycle may indicate a possible over dry.

As mentioned above, the dryer appliance may be connected to, e.g., in communication with, a washing machine appliance. In addition to receiving load type data, as described above, the dryer appliance may also or instead receive data about the washing machine appliance status, which may be indicative of the load of articles from the first sensor cycle remaining in the dryer appliance after the first sensor cycle is complete. For example, when the dryer appliance detects user interactions such as running multiple dry cycles and does not receive data from the connected washing machine appliance which indicates that a new load has been added to the dryer appliance, a possible under dry may be inferred from such detected user interactions. Exemplary washing machine data may include the lid of the washing machine appliance not being opened between the multiple dry cycles, no cycle being run on the connected washing machine appliance during the multiple dry cycles, etc.

The dryer appliance may also or instead receive selection information from the washing machine appliance, such as when a similar or same load is washed in the washing machine appliance with different wash cycle options, that indicate potential dissatisfaction with the dry performance. The similar or same load may be detected using load identifiers such as a load size or load type or another load identification. Washing machine appliance setting selections which may be received by the dryer appliance and which may indicate a potential under dry include an increased spin speed, or an additional spin cycle, e.g., the user may be attempting to extract more moisture from the articles prior to placing them in the dryer appliance, possibly as a result of an under dry in the dryer appliance. Another example washing machine appliance setting selection which may be received by the dryer appliance and which may indicate a potential under dry may include selecting a lower water volume, such as not selecting a deep fill when the deep fill was previously selected for the same or similar load, which may indicate, e.g., that the user is attempting to reduce the moisture content added to the articles during the wash cycle in order to achieve greater drying in the dryer appliance.

In some embodiments, a machine learning classification model may be used to detect unsatisfactory dry performance, as well as categorizing the unsatisfactory dry performance as under dry or over dry. For example, a probabilistic model, e.g., a Bayesian inference model, may be implemented to, over time, predict dissatisfaction and take the appropriate action, e.g., modify cycle parameters, such as defining a new, e.g., second, set of cycle parameters, when a certain level of probability and/or confidence is reached.

The second set of cycle parameters which are defined in response to the one or more detected user interactions may include cycle time, such as greater cycle time (in case of a possible under dry) or lesser cycle time (in case of a possible over dry), e.g., ten percent greater or lesser cycle time for instance of a detected possible unsatisfactory dry cycle. The second set of cycle parameters may also or instead include a changed heat level, such as higher heat in the case of a detected possible under dry or lower heat in the case of a detected possible over dry. The higher or lower heat may be provided by altering a duty cycle of the heater or heating system, such as turning the heating system on for longer or shorter times, and/or by altering a heating level, such as an electrical power level, e.g., voltage, of the heating system when activated during the second or other subsequent dry cycle.

In some embodiments, the second set of cycle parameters may be defined in response to multiple detected possible unsatisfactory dry cycles. For example, the detected user interactions may be weighted, such as according to how likely a particular interaction or event is an indicator of dissatisfaction and/or varying adjustment in response to some events as opposed to others, such as a larger change, e.g., increase or decrease, in the cycle time based on the weight assigned to the detected user interaction.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a dryer appliance, the dryer appliance comprising a cabinet with a drum rotatably mounted within the cabinet, the drum defining a chamber for the receipt of articles for drying, and a heating system fluidly coupled to the drum whereby heated air flows from the heating system to the chamber of the drum for drying of articles within the chamber, the method comprising:

performing a first sensor cycle of the dryer appliance, the first sensor cycle comprising rotating the drum of the dryer appliance and activating the heating system of the dryer appliance according to a first set of cycle parameters;

detecting one or more user interactions with the dryer appliance;

inferring from the one or more detected user interactions that the performance of the first sensor cycle was unsatisfactory;

defining a second set of cycle parameters in response to the one or more detected user interactions; and performing a second sensor dry cycle of the dryer appliance according to the second set of cycle parameters after the first sensor cycle, wherein the one or more detected user interactions comprises opening a door of the dryer appliance prior to completion of the first sensor cycle and without running another cycle of the dryer appliance within a time threshold after opening the door.

2. The method of claim 1, wherein the one or more detected user interactions comprises a timer cycle selection input after the first sensor cycle.

3. The method of claim 2, wherein the timer cycle selection input is received within a first time threshold of a termination of the first sensor cycle and the timer cycle selection input comprises a selected cycle duration of less than a second time threshold.

4. The method of claim 1, wherein the one or more detected user interactions comprises initiating a cycle of the dryer appliance without opening a door of the dryer appliance after the first sensor cycle.

5. The method of claim 1, wherein the one or more detected user interactions comprises repeating the first sensor cycle after a termination of the first sensor cycle.

6. The method of claim 1, wherein the one or more detected user interactions comprises selecting the same cycle for a similar load of articles as the first sensor cycle, and selecting a higher dryness setting than a dryness setting of the first sensor cycle.

7. The method of claim 1, wherein the one or more detected user interactions comprises selecting the same cycle for a similar load of articles as the first sensor cycle, and selecting a lower dryness setting than a dryness setting of the first sensor cycle.

8. The method of claim 1, wherein the one or more detected user interactions comprises a non-heated cycle selection received immediately after a termination of the first sensor cycle.

9. The method of claim 1, wherein the one or more detected user interactions comprises a time setting selection received during the first sensor cycle.

10. A dryer appliance comprising:

a cabinet;

a drum rotatably mounted within the cabinet, the drum defining a chamber for receipt of articles for drying;

a heating system fluidly coupled to the drum whereby heated air flows from the heating system to the chamber of the drum for drying of articles within the chamber; and a controller, the controller configured for:

performing a first sensor cycle of the dryer appliance, the first sensor cycle comprising rotating the drum of the dryer appliance and activating the heating system of the dryer appliance according to a first set of cycle parameters;

detecting one or more user interactions with the dryer appliance;

inferring from the one or more detected user interactions that the performance of the first sensor cycle was unsatisfactory;

defining a second set of cycle parameters in response to the one or more detected user interactions; and performing a second sensor dry cycle of the dryer appliance according to the second set of cycle parameters after the first sensor cycle, wherein the one or more detected user interactions comprises opening a door of the dryer appliance prior to completion of the first sensor cycle and without running another cycle of the dryer appliance within a time threshold after opening the door.

11. The dryer appliance of claim 10, wherein the one or more detected user interactions comprises a timer cycle selection input after the first sensor cycle.

12. The dryer appliance of claim 11, wherein the timer cycle selection input is received within a first time threshold of a termination of the first sensor cycle and the timer cycle selection input comprises a selected cycle duration of less than a second time threshold.

13. The dryer appliance of claim 10, wherein the one or more detected user interactions comprises initiating a cycle of the dryer appliance without opening a door of the dryer appliance after the first sensor cycle.

14. The dryer appliance of claim 10, wherein the one or more detected user interactions comprises repeating the first sensor cycle after a termination of the first sensor cycle.

15. The dryer appliance of claim 10, wherein the one or more detected user interactions comprises selecting the same cycle for a similar load of articles as the first sensor cycle, and selecting a higher dryness setting than a dryness setting of the first sensor cycle.

16. The dryer appliance of claim 10, wherein the one or more detected user interactions comprises selecting the same cycle for a similar load of articles as the first sensor cycle, and selecting a lower dryness setting than a dryness setting of the first sensor cycle.

17. The dryer appliance of claim 10, wherein the one or more detected user interactions comprises a non-heated cycle selection received immediately after a termination of the first sensor cycle.

18. The dryer appliance of claim 10, wherein the one or more detected user interactions comprises a time setting selection received during the first sensor cycle.

19. A dryer appliance comprising:

a cabinet;

a drum rotatably mounted within the cabinet, the drum defining a chamber for receipt of articles for drying;

a heating system fluidly coupled to the drum whereby heated air flows from the heating system to the chamber of the drum for drying of articles within the chamber; and a controller, the controller configured for:

performing a first sensor cycle of the dryer appliance, the first sensor cycle comprising rotating the drum of the dryer appliance and activating the heating system of the dryer appliance according to a first set of cycle parameters;

detecting one or more user interactions with the dryer appliance;

inferring from the one or more detected user interactions that the performance of the first sensor cycle was unsatisfactory;

defining a second set of cycle parameters in response to the one or more detected user interactions; and performing a second sensor dry cycle of the dryer appliance according to the second set of cycle parameters after the first sensor cycle, wherein the one or more detected user interactions comprises a non-heated cycle selection received immediately after a termination of the first sensor cycle.

* * * * *